United States Patent [19]

Eskew

[11] Patent Number: 4,563,124

[45] Date of Patent: Jan. 7, 1986

[54] DOUBLE SUCTION, SINGLE STAGE VOLUTE PUMP

[75] Inventor: William F. Eskew, Horseheads, N.Y.

[73] Assignee: Figgie International Inc., Willoughby, Ohio

[21] Appl. No.: 583,581

[22] Filed: Feb. 24, 1984

[51] Int. Cl.[4] ..... F04D 29/42

[52] U.S. Cl. ..... 415/98; 415/102

[58] Field of Search ..... 415/98, 93, 101, 102, 415/DIG. 3, DIG. 5

[56] References Cited

U.S. PATENT DOCUMENTS

| | | | |
|---|---|---|---|
| 22,773 | 2/1859 | Alden . | |
| 674,832 | 5/1901 | Berg . | |
| 827,750 | 8/1906 | Rateau . | |
| 874,377 | 12/1907 | Akimoff . | |
| 955,168 | 4/1910 | Jones . | |
| 1,031,689 | 7/1912 | Chrisman . | |
| 1,089,770 | 3/1914 | Kerr . | |
| 1,129,038 | 2/1915 | Kerr . | |
| 1,269,063 | 2/1915 | DeLaval . | |
| 1,293,938 | 2/1919 | Ross | 415/94 |
| 1,334,461 | 3/1920 | Kerr | 415/98 |
| 1,673,151 | 6/1928 | Lindemann . | |
| 1,908,427 | 5/1933 | Jennings | 415/98 |
| 2,190,245 | 2/1940 | Sartell | 415/98 |
| 2,207,208 | 7/1940 | Thrush | 103/111 |
| 2,329,373 | 9/1943 | Hornschuch | 103/109 |
| 2,427,307 | 9/1947 | Schleyer | 415/98 |
| 2,804,826 | 9/1957 | Cilker | 103/104 |
| 3,160,107 | 12/1964 | Ross | 103/111 |
| 3,189,149 | 6/1965 | Thomas et al. | 192/82 |
| 3,361,072 | 1/1968 | Tungate et al. | 103/106 |
| 3,412,684 | 11/1968 | Lipe et al. | 103/114 |
| 3,438,330 | 4/1969 | Evans | 103/113 |
| 3,457,869 | 7/1969 | Janetz | 415/DIG. 5 X |
| 3,466,724 | 9/1969 | Morris, Sr. | 29/156.8 |
| 3,499,388 | 3/1970 | Eberhardt | 103/103 |
| 3,500,961 | 3/1970 | Eberhardt et al. | 18/1 |
| 3,671,138 | 6/1972 | Ball | 415/101 X |
| 3,675,014 | 7/1972 | Bevan et al. | 415/200 |
| 3,726,308 | 4/1973 | Eberhardt | 137/527.8 |
| 3,740,162 | 6/1973 | Tuomaala | 415/98 |
| 3,760,478 | 9/1973 | Harlin | 29/156.4 |
| 3,859,703 | 1/1975 | Eberhardt | 29/156.7 R |
| 3,918,681 | 11/1975 | Eberhardt | 251/317 |
| 4,018,544 | 4/1977 | Eberhardt | 415/170 A |
| 4,031,844 | 6/1977 | Onal et al. | 115/12 R |
| 4,131,386 | 12/1978 | Mabe | 415/98 |
| 4,137,006 | 1/1979 | Becker | 415/201 |
| 4,209,282 | 6/1980 | Eberhardt | 417/251 |
| 4,245,952 | 1/1981 | Eberhardt | 415/170 |

FOREIGN PATENT DOCUMENTS

| | | | |
|---|---|---|---|
| 1013341 | 12/1965 | United Kingdom | 415/DIG. 3 |
| 1048272 | 11/1966 | United Kingdom | 415/98 |

*Primary Examiner*—Everette A. Powell, Jr.

*Attorney, Agent, or Firm*—Christel, Bean & Linihan

[57] ABSTRACT

A double suction, single stage volute pump. The pump includes a single piece pump casing (18) which is provided with a single volute defining portion, the portion having a pair of generally circular shroud receiving openings (88, 90). In addition, the pump casing has exterior sidewalls (78, 80) which are disposed on opposite sides of the volute defining portion, each of the sidewalls being provided with an opening (88, 90) in the volute defining portion. A rotary impeller assembly, which includes an impeller (20) and an impeller shaft (22) can be installed into the pump casing from either one side or the other, the impeller assembly passing through a housing receiving opening and a shroud receiving opening until the impeller is properly located within the volute. The pump further includes a pair of impeller shrouds (24, 24) which are secured to opposite sides of the volute defining portion (86), the impeller shrouds covering at least a portion of the shroud receiving openings. A pair of housings (26, 28) are secured to the exterior sidewalls of the pump casing, the housings in turn supporting the impeller shaft (22).

3 Claims, 5 Drawing Figures

DOUBLE SUCTION, SINGLE STAGE VOLUTE PUMP

TECHNICAL FIELD

The present invention relates generally to pumps of the impeller type, and more particularly to a double suction, single stage volute pump.

BACKGROUND

One of the principal forms of firefighting equipment in use today is a vehicle customarily referred to as a pumper. Mounted upon the frame of this vehicle is a large pump which can typically receive water from either side of the vehicle, raise the pressure of the water and discharge it to either side of the vehicle. The pump may be of a single impeller design as shown in U.S. Pat. No. 3,500,961 or a multiple impeller design as shown in U.S. Pat. No. 3,726,308. Both single and multiple volute pumps have their own advantages, and the principal advantage of the single volute pump is its lower cost and simplicity of operation. However, prior art double suction, single volute pumps of the type shown in U.S. Pat. No. 3,500,961 have horizontally split housings to provide access to the impeller and shaft. This form of design therefore requires special sealing considerations where the impeller shaft passes between the castings. In addition, service of the double suction, single volute pumps presents certain problems. Thus, if the lower casting is to be removed to provide access, it is necessary to work within the space provided within a truck between the fore and aft extending main frame members. This can be avoided by removing the entire pump from the vehicl, but this in turn requires disconnection of many fluid lines. Similarly, if access is to be provided by removing the top half of the pump casing, it is also necessary to remove many fluid lines. Therefore, service on such pump designs cannot be readily performed.

OBJECTS AND SUMMARY OF THE INVENTION

It is an object of the present invention to provide a low cost double suction, single stage volute pump requiring minimal machining time, assembly labor and material costs, which pump can also be readily serviced.

The above object is accomplished by providing a single piece pump casing design which is provided with a single volute defining portion having a pair of generally circular shroud receiving openings on the sides of the volute defining portion. In addition, the pump casing has exterior sidewalls which are disposed on opposite sides of the volute portion, each of the sidewalls being provided with an opening for receiving a housing, the housing receiving opening being coaxial with the shroud receiving openings in the volute defining portion. A rotary impeller assembly, which includes an impeller and an impeller shaft can be installed into the pump casting or casing from one side or the other, the impeller assembly passing through a housing receiving opening and a shroud receiving opening until the impeller is properly located within the volute. The pump further includes a pair of impeller shrouds which are secured to opposed sides of the volute portion, the impeller shrouds covering at least a portion of the shroud receiving openings. A pair of housings are secured to the exterior sidewalls of the pump casting, the housings in turn supporting the impeller shaft.

The above object and other objects and advantages of the invention will become more apparent after a consideration of the following detailed description taken in conjunction with the accompanying drawings in which a preferred form of this invention is illustrated.

DETAILED DESCRIPTION

Figure 1:
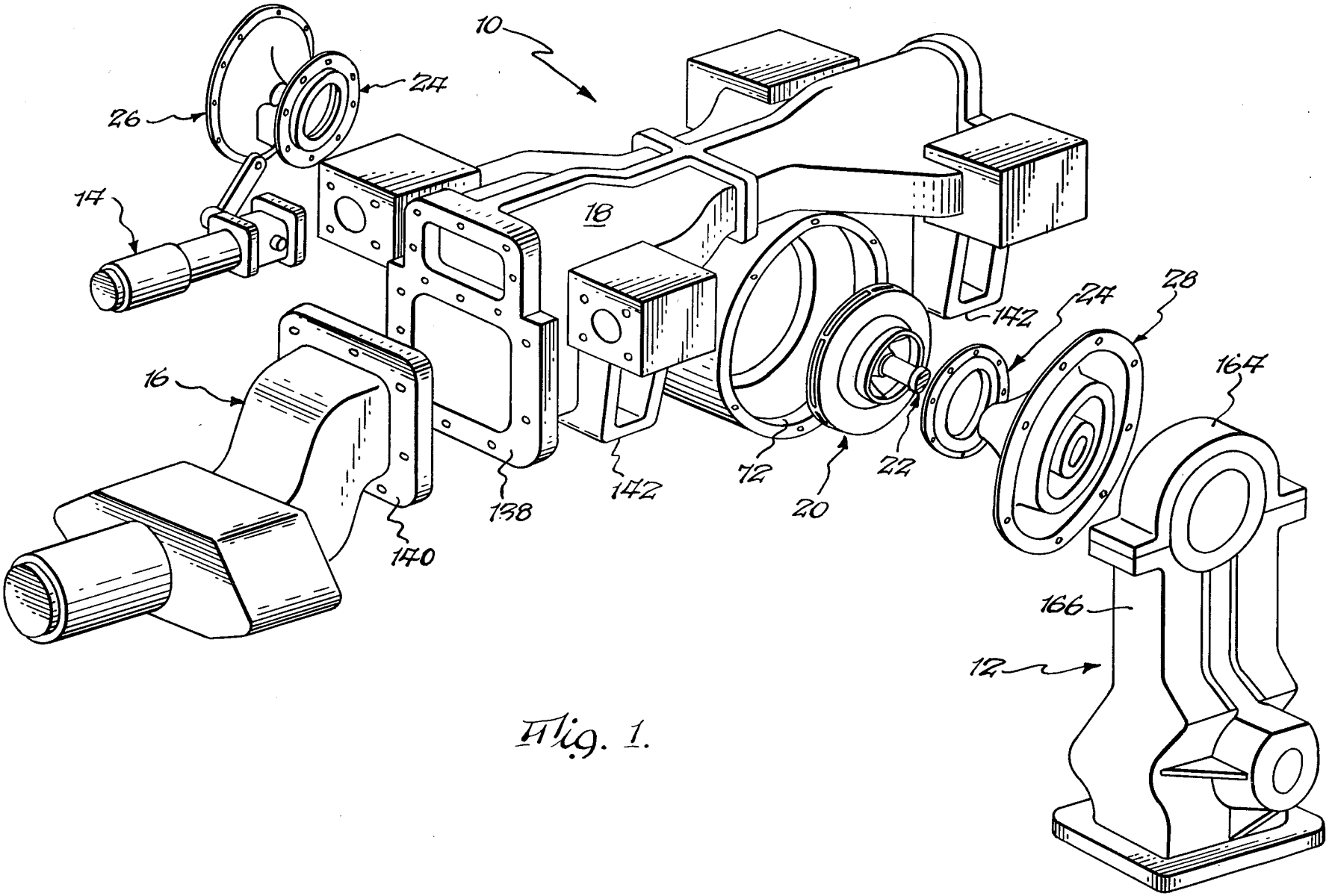
FIG. 1 is an exploded perspective view of the pump of this invention and associated components.

Referring first to FIG. 1, the double suction, single stage volute pump of this invention, which is indicated generally at 10, is adapted to be driven by a transmission disposed within a transmission housing indicated generally at 12. When in use the pump will normally be connected to the frame of a vehicle, such as a pumper, and the transmission housing may be disposed directly forwardly of the pump. The transmission is in turn adapted to be interconnected with a drive shaft extending rearwardly from the vehicle engine in a manner not material to the present invention. As the vehicle design is well known, the vehicle is not illustrated. In the embodiment illustrated four discharge outlets, indicated generally by the reference numeral 14, are associated with the pump only one of which is shown in FIG. 1. Thus, there are two discharge outlets on each side of the pump. Fire hoses may in turn be connected to the discharge outlets. Finally, intake manifolds 16 are also provided, there being one on each side of the pump, only one being illustrated in FIG. 1. The intake or suction manifolds 16 can be in turn connected to fire hydrants, ponds, etc. by suitable lines. As the fluid connections 14 and 16 to the pump 10 form no part of the present invention, they will not be described in further detail.

The principal components of the pump are a single piece pump casing 18, a rotary impeller assembly, which assembly includes an impeller 20 and an impeller shaft 22, a pair of substantially identical impeller shrouds 24, a bearing housing 26, and a seal housing 28.

Figure 2:
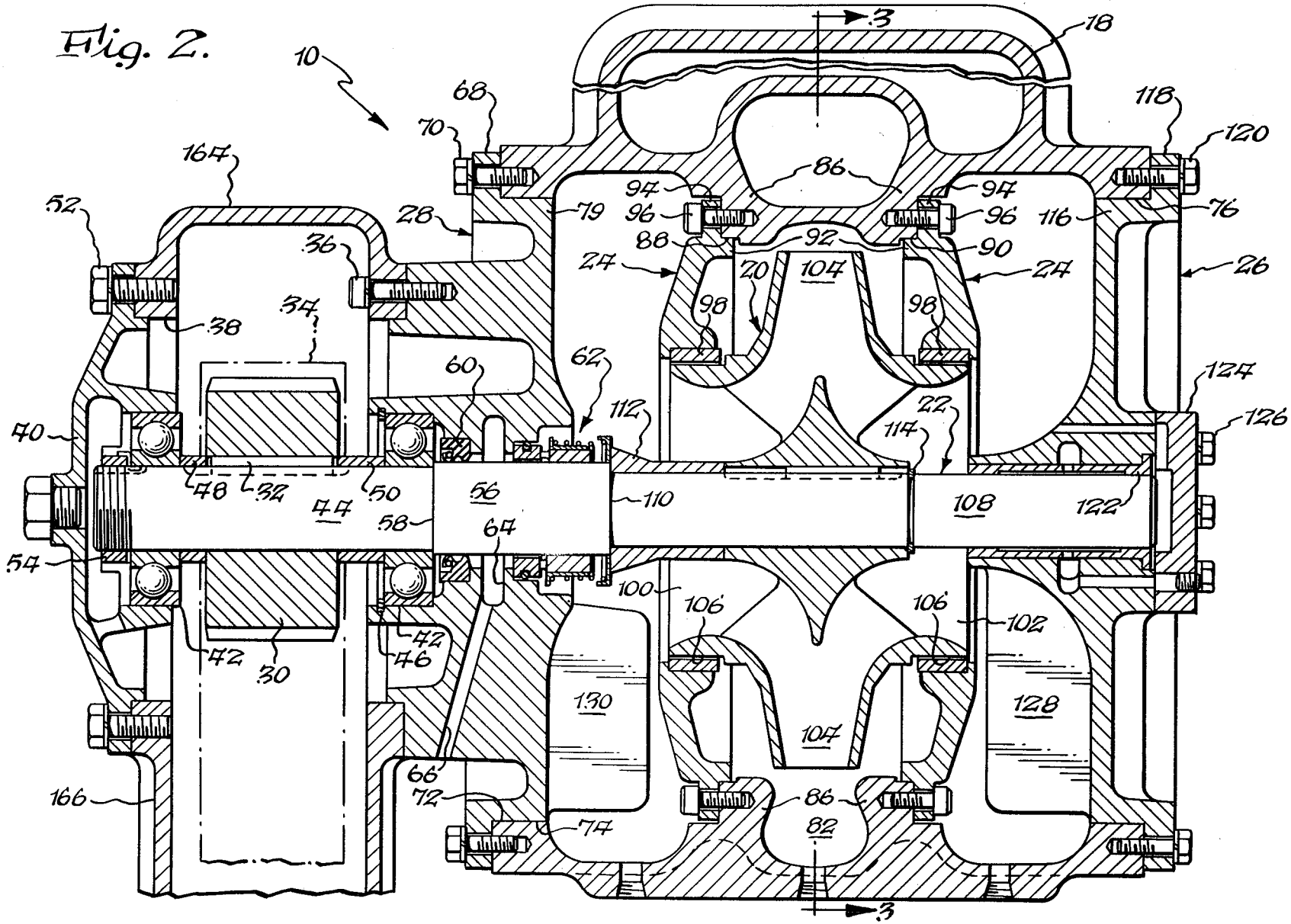
FIG. 2 is a cross-sectional view showing the various components in their assembled position.

Referring now to FIG. 2, in which the pump and the upper end of the transmission are shown in cross section, it can be seen that the impeller shaft 22 is adapted to be rotated by means of a sprocket 30 which is secured in place by a key 32. The sprocket 30 is in turn caused to be rotated by a chain 34 which is driven by another sprocket (not shown) in a lower portion of the transmission housing 12. The transmission case is secured to the pump 10 by means of a plurality of bolts 36, only one of which is shown in FIG. 2, the bolts being received in a plurality of spaced apart threaded apertures in the seal housing 28. The side of the transmission opposite the bolts 36 is provided with an opening 38, which opening is closed by an outboard bearing housing 40. The seal housing 28 and the outboard bearing housing 40 are each provided with a portion capable of receiving the outer race of an associated ball bearing, the inner race of each bearing 42 being disposed about an end portion 44 of the shaft 22. The ball bearing within the seal housing 28 is retained in place by a retaining ring 46. Spacers 48 and 50 are spaced to either side of the sprocket 30 and function to maintain the sprocket 30 and key 32 in their assembled position. The outboard bearing housing 40 is secured to the transmission case 12 by bolts 52. Also, a nut 54 is secued to the threaded end of the shaft 22 to hold the shaft 22, bearings 42, spacers 48, 50, and sprocket 30 in their assembled position.

The shaft 22 has a larger diameter portion 56 which is disposed generally within the seal housing 28, the shaft portions 44 and 56 forming a shoulder which abuts the inner race of the bearing 42 carried by the seal housing 28. The seal housing is provided with an annular groove adjacent the bearing 42 for the reception of a double lip oil seal 60 which bears against the portion 56 and serves to retain oil within the transmission case 12. An end face seal assembly, indicated generally at 62, is also mounted upon the larger portion 56 of the shaft 22, a portion of the seal assembly 62 being received within an annular recess in the seal housing 28. In the event that there is leakage past either of the seals 60 or 62, a gallery 64 and drain 66 are provided in seal housing 28. The seal housing is provided with a radially outwardly extending lip portion 68 which is provided with a plurality of circumferentially spaced apart apertures which receive mounting bolts 70, the mounting bolts 70 in turn being receiving within suitable apertures in the pump casting 18. The exterior sidewall of the pump adjacent the transmission case 12 is also provided with a cylindrical opening 72 (FIG. 1) for receiving a cylindrical portion 74 of the seal housing 28.

Figure 3:
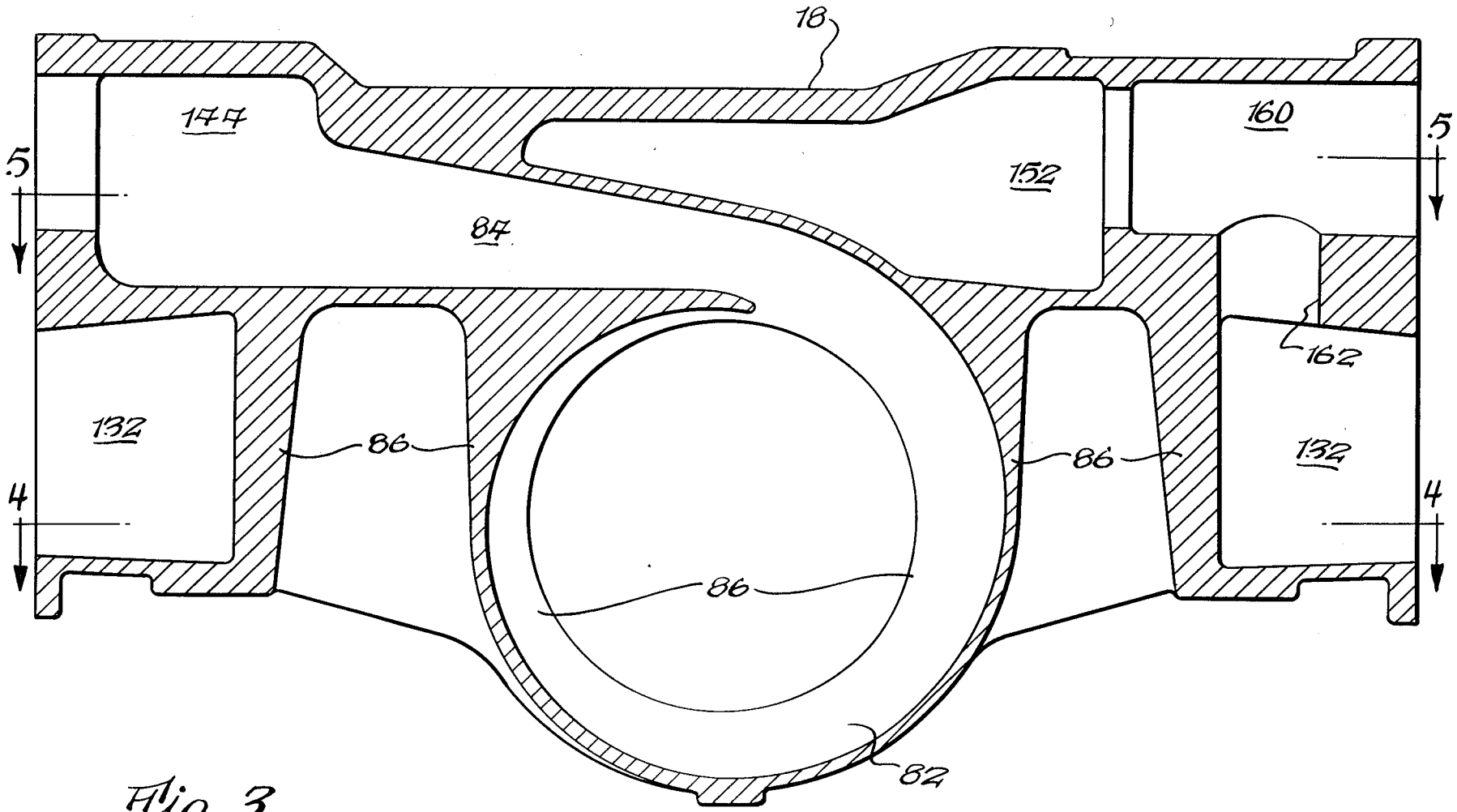
FIG. 3 is a section of the pump casing taken generally along the line 3—3 in FIG. 2.
Figure 4:
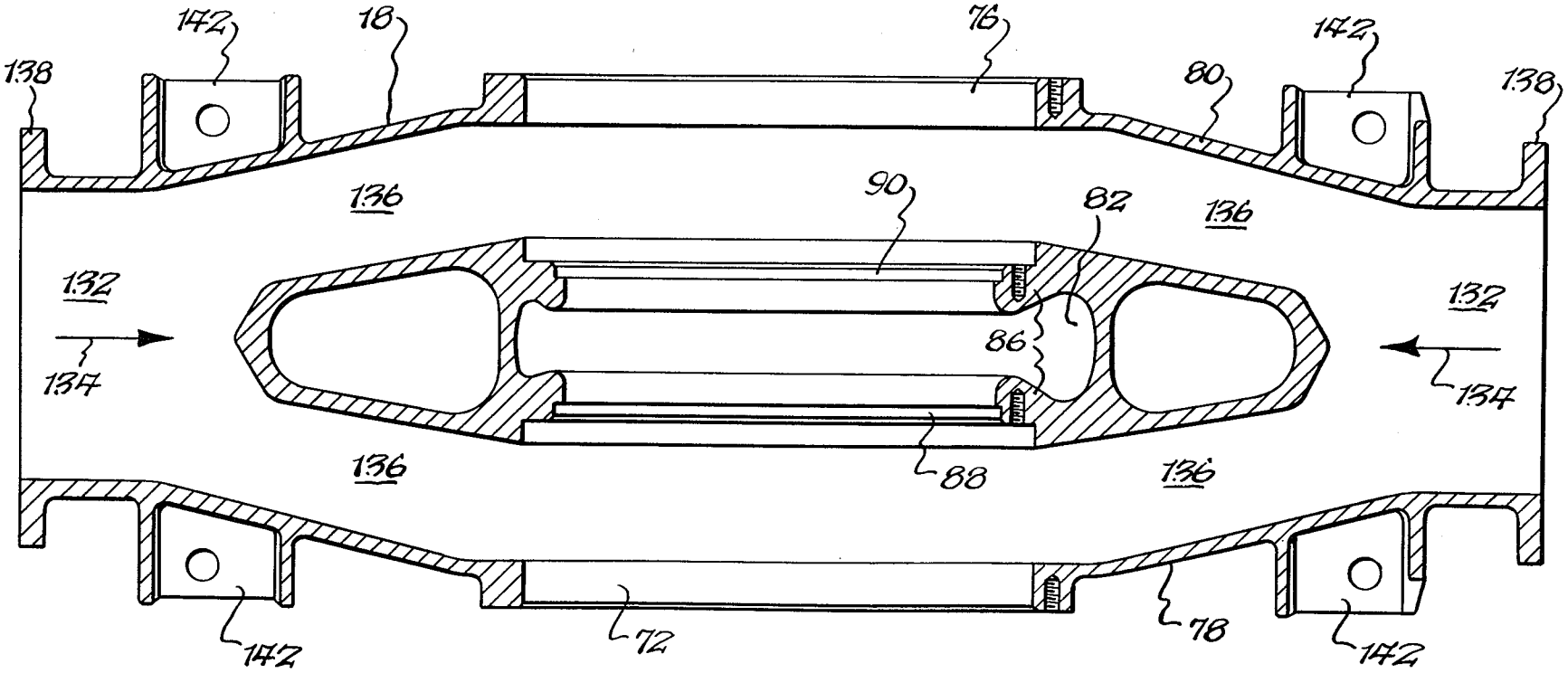
FIGS. 4 and 5 are sections taken generally along the lines 4—4 and 5—5 in FIG. 3.
Figure 5:
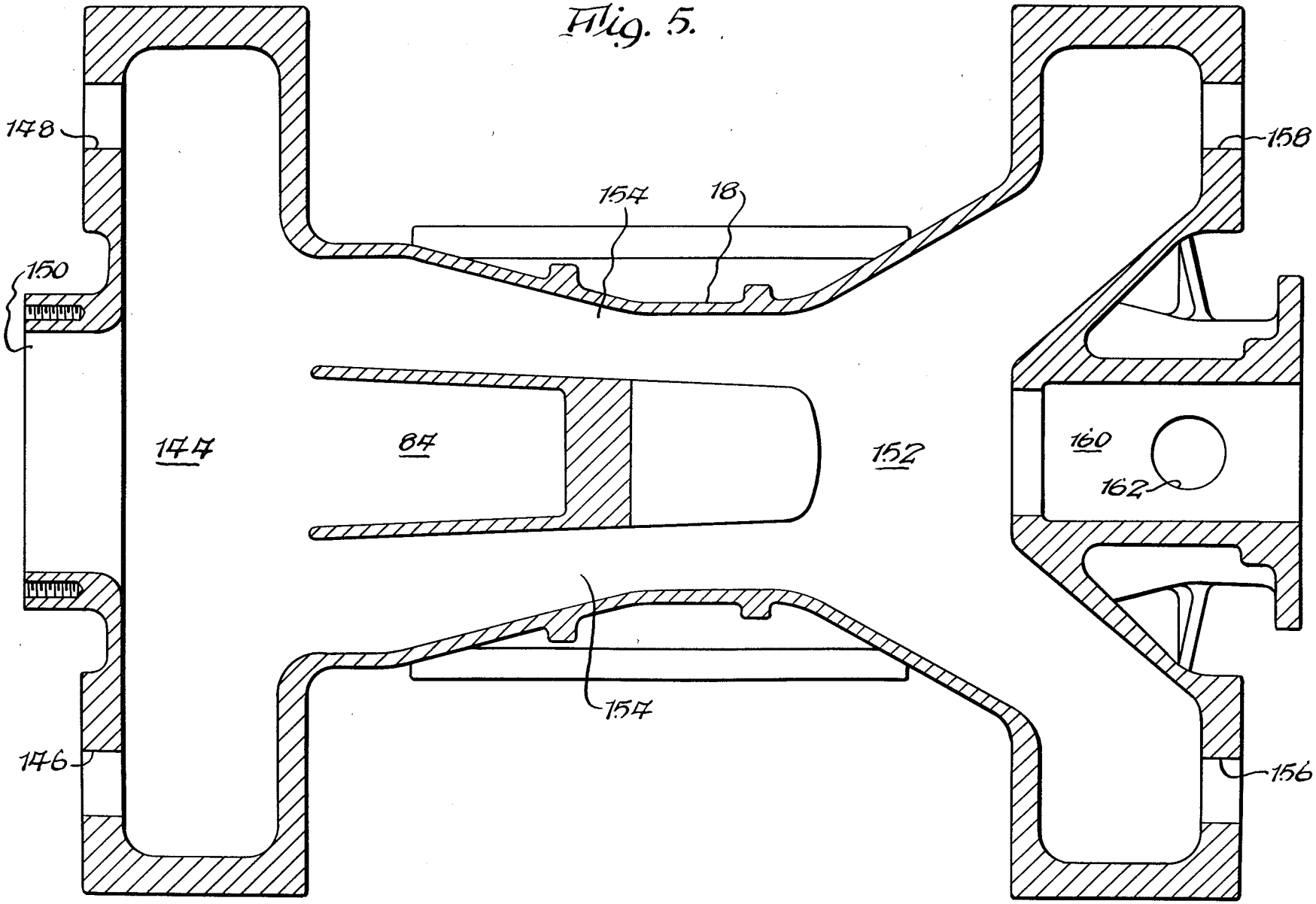

With reference now to FIG. 4, it can be seen that the pump housing is also provided with another cylindrical opening 76, the openings 72 and 76 being formed in spaced apart sidewalls 78 and 80, respectively. The pump casing is also formed with a single volute 82 having a discharge 84 (FIGS. 3 and 5). The volute 82 is formed by a generally circumferential volute defining portion 86 of the casting, the volute defining portion 86 being provided with a pair of generally circular shroud receiving openings 88, 90 (FIG. 4). As previously noted the shrouds 24 are substantially identical, each shroud having a cylindrical portion 92 (FIG. 2) received within the associated shroud receiving opening 88, 90, and a flange portion 94 received within an annular recess about the openings 88 and 90, the flange portion being in turn secured in place by a plurality of bolts 96. Each of the shrouds is provided with a radially inner cylindrical recess which receives a wear ring 98.

The impeller 20 is of generally conventional construction having opposed inlet eyes 100, 102 and centrally located discharge orifices 104. The impeller additionally has opposed external cylindrical portions 106 which are adapted to be received with the wear rings 98. The shaft 22 is provided with a further reduced diameter portion 108 which forms with the larger diameter portion 56 another shoulder 110. An abutment portion 112 of the impeller assembly bears against the shoulder 110 and is held in place by a retaining ring 114. The impeller is keyed to the shaft 22 so that it will rotate with the shaft and the sprocket 30.

The bearing housing 26 is provided with a cylindrical portion 116 and a radially outwardly extending flanged portion 118 provided with a plurality of circumferentially spaced apart openings which will receive bolts 120 to secure the bearing housing in its assembled position with portion 116 within opening 76. The radially inner portion of the bearing housing 26 is provided with a portion which receives a tapered journal bearing 122 which rotatably receives the end portion of shaft 22. A cover 124 is secured to the bearing housing 26 by bolts 126 and serves to cover the cylindrical bore which receives the bearing 122.

As can be seen from FIG. 2 both the bearing housing 26 and the seal housing 28 are each provided with a radially inwardly extending fixed vane 128, 139, respectively, which vanes assist in the operation of the pump.

Referring now in further detail to FIG. 4 it can be seen that the pump casting is provided with right and left inlet passageways 132, the water flow, during operation of the impeller assembly, normally flowing in the direction indicated by the arrows 134, the inlets 132 being divided by the volute defining portion 86 to provide passageways 136. These passageways extend to the eyes 100, 102 of the impeller, and in this respect it should be noted that the shrouds 24 serve to form an extension of the passageways 136. The casting is provided with a flange 138 about the beginning of each of the inlets 132 and the flanged portion 140 of an intake manifold 16 can be secured thereto by suitable fasteners.

As can also be seen in FIG. 1, the casting is provided with mounting pads 142. Thus, these pads 142 can be disposed upon portions of the frame of a vehicle and secured thereto by bolts or the like.

Referring now to FIG. 5, it can be seen that the discharge portion 84 of the volute 82 terminates in a left hand discharge header 144. This header is provided with forward and rear ports 146 and 148, respectively, which may be connected to discharge outlets in a conventional manner, such as by bolting the outlet to the face of the casting about the outlet port. In addition, the casting is provided with a service port 150 which is customarily closed by an access cover plate (not shown). The left hand discharge header 144 is interconnected with a right hand discharge header 152 by a pair of generally parallel passageways 154 which are disposed to either side of the discharge portion 84. The casting portion which forms the right hand header 152 is also provided with front and rear discharge ports 156 and 158 and a valve port 160. The valve port 160 is customarily provided with a relief valve (not shown) which permits high pressure fluid to pass through the port 160 and return bore 162 back to inlet 132. After a valve has been assembled in to the valve port 160 the port is closed with a cover plate (not shown).

The pump of the present design can be serviced with greater facility than other comparable pumps. Thus, if it is necessary to service the pump, it is not necessary to disconnect any of the plumbing associated with the pump under most circumstances. To service the pump the outboard bearing housing 40 is first removed and then nut 54 and the left hand bearing 42 are removed. At this time it is desirable to remove the top half 164 of the transmission case 12, leaving the bottom half 166, in place. The chain is now removed from the sprocket 30, and the spacers 48 and 50 and sprocket 30 are removed from the shaft 22. Next the bearing housing 26 is removably by simply unfastening the bolts 120. This provides access to the interior of the pump housing. If it is necessary to service the impeller, the right hand impeller shroud 24 is removed by unfastening the bolts 96 and the shroud is then removed permitting the removal of shaft 22 and the impeller 20. The impeller 20 can now be serviced and the right hand wear ring 98 can also be serviced. If necessary to service the left hand wear ring, it is first necessary to drop the lower half or bottom half of the transmission 166. Then the seal housing 28 is removed and then the left hand shroud 24 can be removed for servicing the left hand wear ring 98. The parts are reassembled in the reverse order.

As the operation of impeller pumps are well known to those skilled in the art, it will not be described here.

While a preferred design in which the principles of the present invention have been incorporated as shown and described above, it is to be understood that the invention is not to be limited to the particular details, as shown and described above, but that, in fact, widely differing means may be employed in the practice of the broader aspects of this invention.

What is claimed is:

1. A double suction single stage volute pump assembly suitable for use in firefighting equipment comprising:

a single piece pump casing having a single volute defining portion provided with a pair of generally circular coaxial shroud receiving openings in the sides thereof and a discharge portion lying in a plane intermediate the shroud receiving openings, exterior sidewalls disposed on opposite sides of said volute defining portion, each of said sidewalls being provided with a housing receiving opening coaxial with the shroud receiving openings, a pair of opposed inlets lying in the plane of the discharge portion, one inlet being disposed to one side of a vertical plane passing through the center line of the pair of generally circular shroud receiving openings, and the outer inlet being disposed to the other side of said vertical plane, a pair of opposed discharge headers in fluid communication with the discharge portion of the volute, one of said discharge headers lying to one side of said vertical plane, and the othr discharge header lying to the other side of said vertical plane, and a pair of passageways extending from each inlet to eithr side of the volute defining portion;

a rotary impeller assembly including an impeller and an impeller shaft, the impeller being mounted within the volute defining portion of the pump casing, the diameter of said impeller assembly being less than the diameter of said housing receiving openings and said shroud receiving openings so that said impeller may be inserted through a housing receiving opening and a shroud receiving opening for assembly or disassembly;

a pair of removable impeller shrouds normally secured to the sides of the volute defining portion of the pump casing about said shroud receiving openings, each of said shrouds having a diameter less than the diameter of said housing receiving openings so that said impeller shrouds may be inserted through an associated housing receiving opening for assembly to or disassembly from the volute defining portion of the single piece pump casing; and a pair of housings secured to the exterior sidewalls of the pump casing, said housings supporting the impeller shaft.

2. The double suction single stage volute pump as set forth in claim 1 wherein the removable impeller shrouds and housings form extensions of said passageways.

3. The double suction single stage volute pump as set forth in claim 1 wherein the pair of removable impeller shrouds are substantially identical, each of said removable impeller shrouds including a radially inner cylindrical recess which receives a cylindrical wear ring, said wear ring being adapted to be disposed about a cylindrical portion of the impeller adjacent one of the eyes of the impeller.

* * * * *